US011839288B2

(12) United States Patent
Durham et al.

(10) Patent No.: US 11,839,288 B2
(45) Date of Patent: Dec. 12, 2023

(54) FASTENING MECHANISM

(71) Applicant: Nomatic Holdings, LLC, Sandy, UT (US)

(72) Inventors: Jacob Peter Durham, Sandy, UT (US); Jon Stephen Richards, Highland, UT (US); David Wayne Bradley, Lehi, UT (US)

(73) Assignee: Nomatic Holdings, LLC, Sandy, UT (US)

( * ) Notice: Subject to any disclaimer, the term of this patent is extended or adjusted under 35 U.S.C. 154(b) by 1 day.

(21) Appl. No.: 17/701,331

(22) Filed: Mar. 22, 2022

(65) Prior Publication Data

US 2023/0301418 A1 Sep. 28, 2023

(51) Int. Cl.
*A45F 3/04* (2006.01)
*A45F 3/00* (2006.01)

(52) U.S. Cl.
CPC ..... *A45F 3/04* (2013.01); *A45F 2003/001* (2013.01)

(58) Field of Classification Search
CPC .. A45F 3/04; A45F 3/042; A45F 3/047; A45F 3/06
See application file for complete search history.

(56) References Cited

U.S. PATENT DOCUMENTS 3,549,064 A * 12/1970 Wilson ..... B25H 3/023 224/616
5,911,348 A * 6/1999 Shook ..... A45F 3/04 224/629
7,712,645 B2 * 5/2010 Calkin ..... A61F 17/00 224/191
7,886,949 B2 * 2/2011 Fenton ..... A45F 3/04 224/652
8,245,825 B2 8/2012 Yoneno et al.
10,772,410 B2 * 9/2020 Goulet ..... A45F 3/04
10,905,907 B1 * 2/2021 Dold ..... B25G 1/102
D982,419 S * 4/2023 Chun ..... D8/367
2006/0102676 A1 * 5/2006 Gibson ..... A45F 3/04 224/648

(Continued)

FOREIGN PATENT DOCUMENTS

FR 2747279 A1 * 10/1997 ..... A45C 13/1046

OTHER PUBLICATIONS

Butterbeescraps' Artistic Treasures "Tutorial of the Week: Mini Album Closures Part II" retrieved from the Internet: https://butterbeescraps.com/mini-album-closures-part-ii/, retrieved on Feb. 24, 2022, pp. 1-12.

(Continued)

*Primary Examiner* — Scott T McNurlen
(74) *Attorney, Agent, or Firm* — Foley & Lardner LLP

(57) ABSTRACT

A bag including a body forming a cavity, a flap comprising a first flap end and a second flap end, wherein the first flap end is attached to the body. The bag may also include a cord having a first end, a second end, and a middle portion, wherein the first end is attached to the second flap end, the second end is attached to the second flap end, and the middle portion extends between the first end and the second end. The bag may also include a hook attached to the body at an attachment location, wherein the hook is configured to receive the middle portion of the cord such that the flap is secured to the body at the attachment location and the flap covers the cavity.

11 Claims, 12 Drawing Sheets

(56) References Cited

U.S. PATENT DOCUMENTS

| | | | | |
|---|---|---|---|---|
| 2006/0144885 | A1* | 7/2006 | Smeuninx | A45F 3/047 224/644 |
| 2017/0332771 | A1* | 11/2017 | Tandeski | A45F 5/021 |
| 2021/0068519 | A1 | 3/2021 | Rogers et al. | |

OTHER PUBLICATIONS

Unicef Market, "Indian Black Brocade Button-Close Handmade Paper Journal, 'Artistic Black'", retrieved from the internet: https://www.market.unicefusa.org/p/indian-black-brocade-button-close-handmade/U29933/, retrieved on Feb. 24, 2022, pp. 1-4.

* cited by examiner

FASTENING MECHANISM

CROSS-REFERENCE TO RELATED PATENT APPLICATIONS

None.

BACKGROUND

Bags and other containers commonly require two hands to fasten or close. Buttons, snaps, ties, and zippers often require two hands to operate. Additionally, such fastening mechanisms take time to operate, causing frustration for users who wish to frequently fasten and unfasten a bag.

SUMMARY

Aspects of one embodiment of the present disclosure relate to a bag including a body forming a cavity, a flap comprising a first flap end and a second flap end, wherein the first flap end is attached to the body. The bag may also include a cord having a first end, a second end, and a middle portion, wherein the first end is attached to the second flap end, the second end is attached to the second flap end, and the middle portion extends between the first end and the second end. The bag may also include a hook attached to the body at an attachment location, wherein the hook is configured to receive the middle portion of the cord such that the flap is secured to the body at the attachment location and the flap covers the cavity.

In some embodiments, the panel may be a rigid panel.

In some embodiments, the flap may form a flap cavity that combines with the cavity formed by the body when the flap is secured to the body.

In some embodiments, the cord may be an elastic cord.

In some embodiments, the bag may include a hinge portion hingeably connecting the first flap end to the body.

In some embodiments, the hook is attached to the body using rivets.

In some embodiments, the hook includes an upper portion, a lower portion, and a back portion connecting the upper portion and the lower portion. In some embodiments, the upper portion is flat, the lower portion is flat, and the back portion has an exterior flat surface and an interior curved surface. In some embodiments, the interior curved surface is convex along a first axis and concave along a second axis orthogonal to the first axis. In some embodiments, the interior curved surface is configured to reduce strain on the cord.

Aspects of another embodiment of the present disclosure relate to a system including an elastic cord having a first end, a second end, and a middle portion, wherein the first end is attached to a first member, the second end is attached to the first member, and the middle portion extends between the first end and the second end. The system may also include a hook attached to a second member and configured to receive the cord, wherein tension in the cord when the cord is received by the hook biases the first member towards the second member.

In some embodiments, the first member is a panel of a bag and the second member is a body of a bag. In some embodiments, a first end of the first member is attached to the second member. In some embodiments, the first member is configured to cover a cavity of the second member when the cord is received by the hook.

In some embodiments, the first member is a rigid panel. In some embodiments, the first member forms a first cavity that combines with a second cavity formed by the second member when the first member is biased towards the second member.

In some embodiments, the hook includes an upper portion, a lower portion, and a back portion connecting the upper portion and the lower portion. In some embodiments, the upper portion is flat, the lower portion is flat, and the back portion has an exterior flat surface and an interior curved surface. In some embodiments, the interior curved surface is convex along a first axis and concave along a second axis orthogonal to the first axis. In some embodiments, the interior curved surface is configured to reduce strain on the cord.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

The quick closure mechanism discussed herein has many advantages over conventional products and methods. The quick closure mechanism can be operated with one hand and can be applied to fasten flexible and rigid containers. The quick closure mechanism allows a container such as a bag or sling to be quickly opened and closed. The quick closure mechanism is easy to use and requires less precision to successfully fasten a container than conventional fastening methods.

The quick closure mechanism discussed herein has various potential applications. The mechanism could be used to secure a flap of a backpack closed. The mechanism could be used on a backpack in addition to another fastening or closure mechanism such as a zipper, button, or snap. This could allow a user to use the quick closure mechanism when quick and easy access is preferred and another fastening mechanism when greater security is preferred. The quick closure mechanism could be implemented on a sling, a fanny pack, a laptop bag, or other bag or container. The quick closure mechanism could be used on a sling having two hard shells or panels joined together by a hinge. The quick closure mechanism could be used to hold the two shells together opposite the hinge to secure the contents of the sling. The quick closure mechanism could also be used in conjunction with another fastening mechanism so that a user of the sling can use the quick closure mechanism when quick and easy access if preferred and another mechanism when greater security is preferred.

Figure 1:
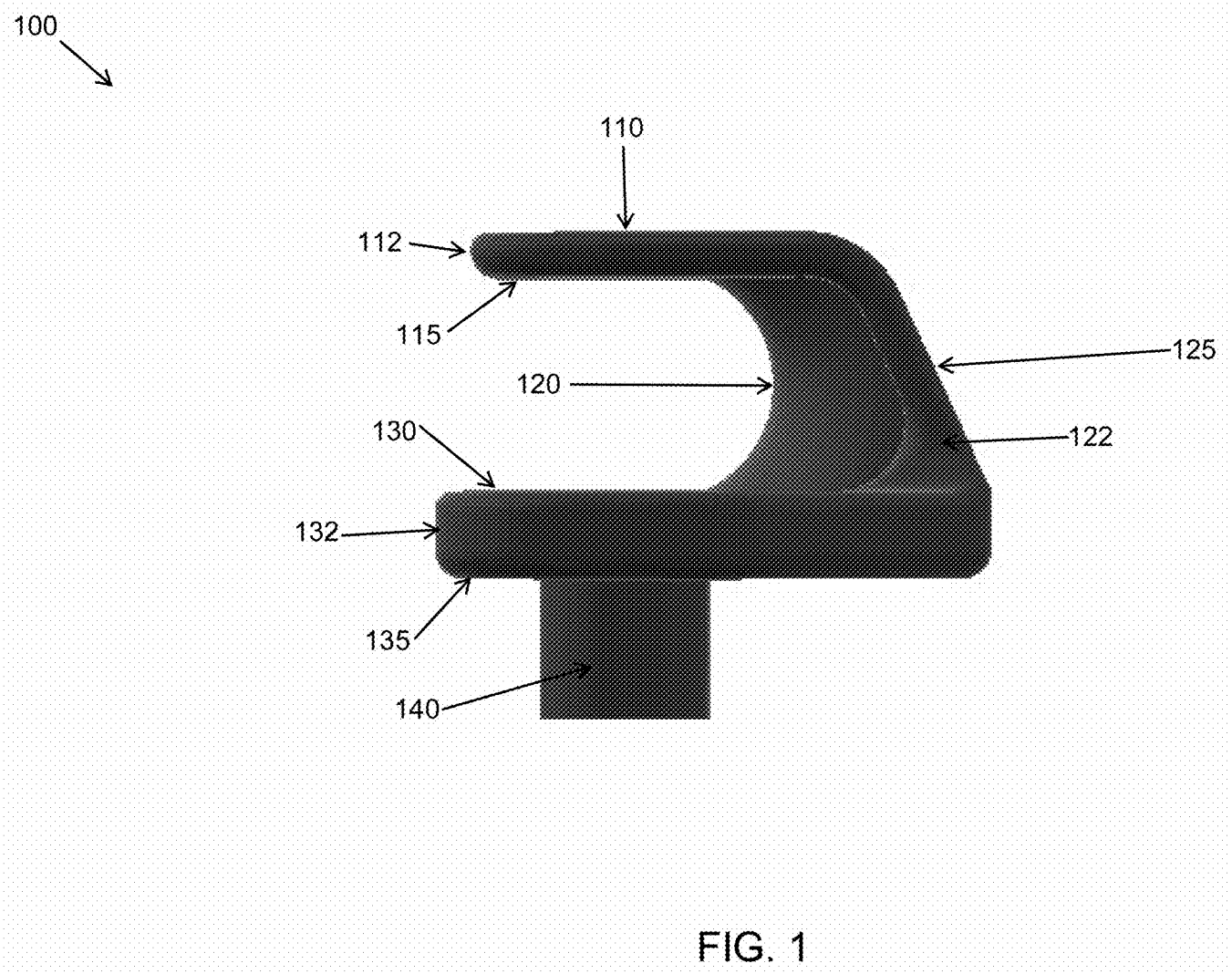
FIG. 1 is a side view of a hook portion of a fastening mechanism according to one or more embodiments.

FIG. 1 is a side view of a hook portion 100 of a fastening mechanism according to one or more embodiments. The hook 100 may include an upper portion 112, a back portion 122, a lower portion 132, and one or more rivets 140. The upper portion 112 may include an upper portion exterior surface 110 and an upper portion interior surface 115. The back portion 122 may include a back portion interior surface 120 and a back portion exterior surface 125. The lower portion 132 may include a lower portion interior surface 130 and a lower portion exterior surface 135. The upper portion exterior surface 110 may be flat. The upper portion interior surface 115 may be flat. The lower portion interior surface 130 may be flat. The lower portion exterior surface 135 may be flat. The back portion 122 may connect the upper portion 112 and the lower portion 132. The back portion exterior surface 125 may be flat. The back portion interior surface 120 may be a curved surface. The hook 100 may be configured to receive a cord within the upper portion interior surface 115, the bottom portion interior surface 130, and the back portion interior surface 120. The cord may be biased towards the back portion 122. The back portion interior surface 120 may be curved so as to reduce strain in the cord when the cord is stretched over the back portion interior surface 120. The hook may be metal, wood, plastic, or another rigid material.

The upper portion 112 may be flat. The lower portion 132 may be flat. The upper portion 112 may be parallel to the lower portion 132. In some embodiments, the upper portion 112 may have less surface area than the lower portion 132. In other embodiments, the upper portion 112 may have greater surface area than the lower portion 132. In some embodiments, the upper portion 112 may have the same thickness as the lower portion 132. In other embodiments, the upper portion 112 may have a lesser thickness or greater thickness than the lower portion 132.

Figure 2:
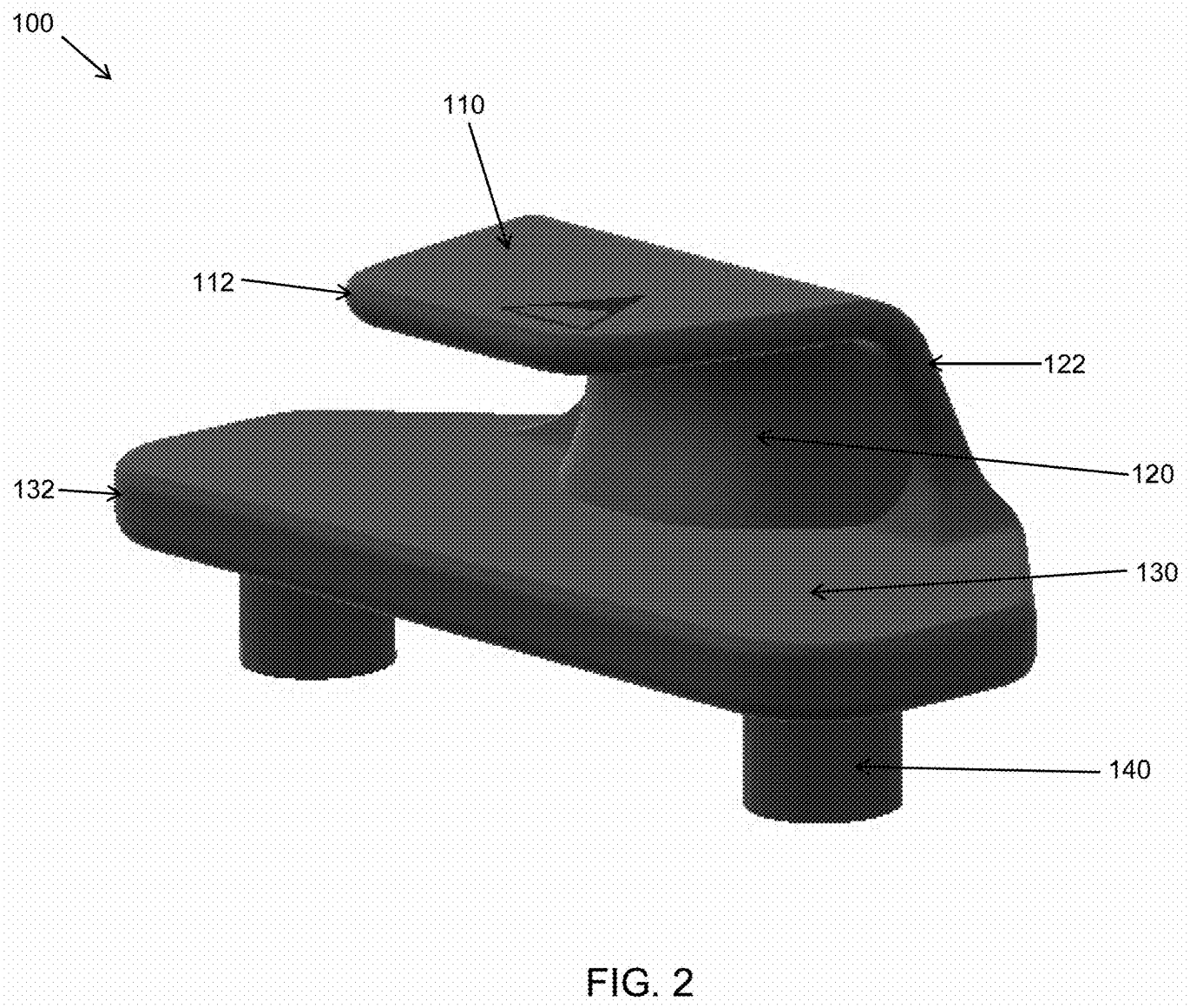
FIG. 2 is an upper perspective view of the hook of FIG. 1.

FIG. 2 is an upper perspective view of the hook 100 of FIG. 1. As shown in FIG. 2, the back portion interior surface 120 may be a saddle surface, being concave in a first direction and convex in a second direction. The back portion interior surface 120 may be concave along an axis stretching from the lower portion 132 to the upper portion 112 such that the edges of the back portion interior surface 120 which touch the upper portion 112 and the lower portion 132 extend farther from the back portion 122 than the middle of the back portion interior surface 120. The back portion interior surface 120 may be convex along an axis stretching through the opening formed by the upper portion 112, the back portion 122, and the lower portion 132 such that the middle of the back portion interior surface 120 extends farther from the back portion 122 than the edges of the back portion interior surface 120 which touch the back portion 122. This has the advantage of biasing a cord received by the hook 100 towards the center of the back portion interior surface 120 while reducing strain on the cord. The concave nature of the back portion interior surface 120 biases the cord towards the center of the back portion interior surface 120 as the cord is pulled towards the back portion 122. The convex nature of the back portion interior surface 120 reduces strain on the cord as the cord is pulled towards the back portion 122. This has the advantage of reducing wear on the cord.

Figure 3:
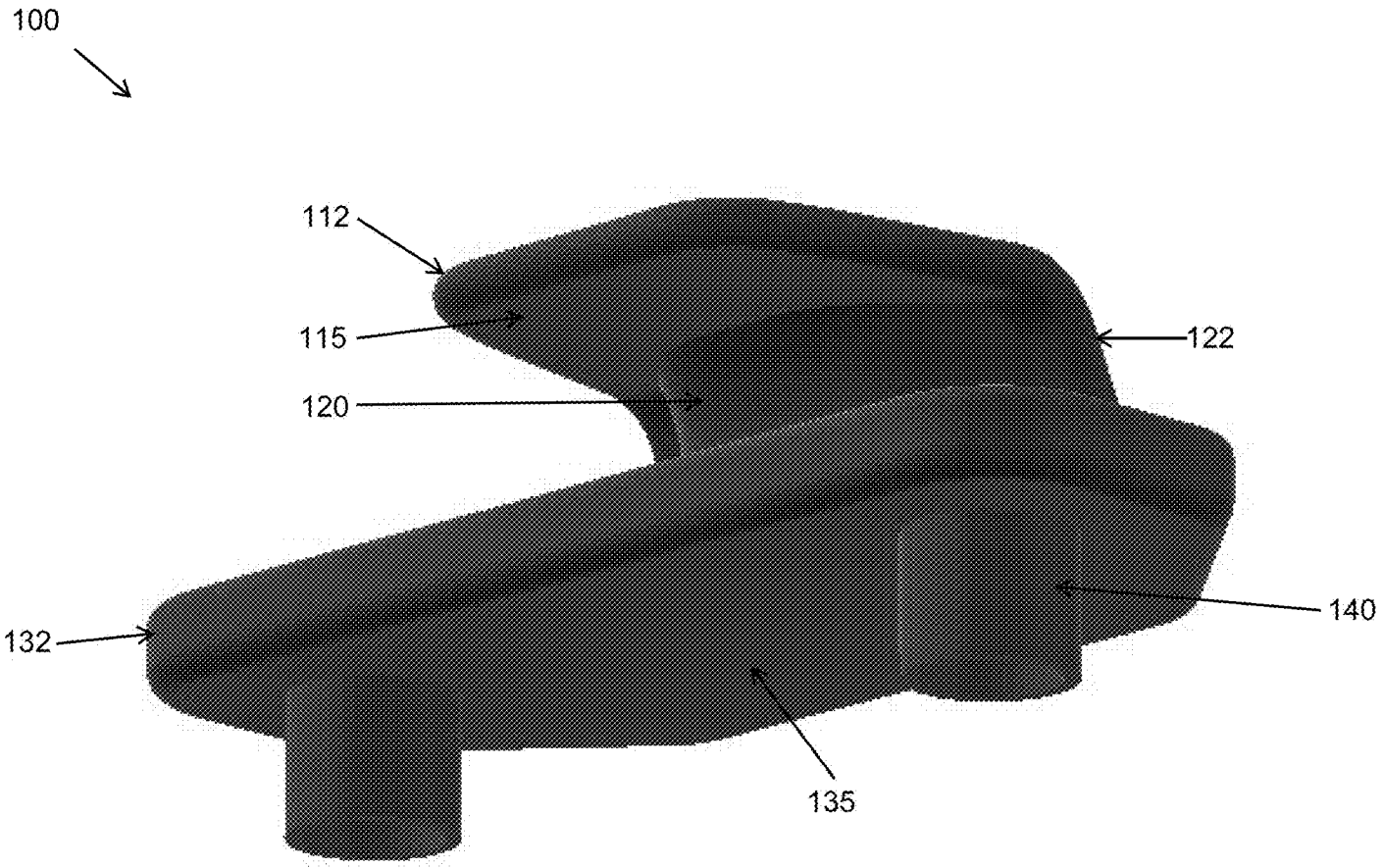
FIG. 3 is a lower perspective view of the hook of FIG. 1.

FIG. 3 is a lower perspective view of the hook 100 of FIG. 1. The one or more rivets 140 may extend through a surface to which the hook 100 is attached to secure the hook 100 to the surface. In some embodiments, the one or more rivets 140 may be deformed to secure the hook 100 to the surface. In other embodiments, the one or more rivets 140 may be attached to one or more washers or other elements to secure the hook 100 to the surface.

Figure 4:
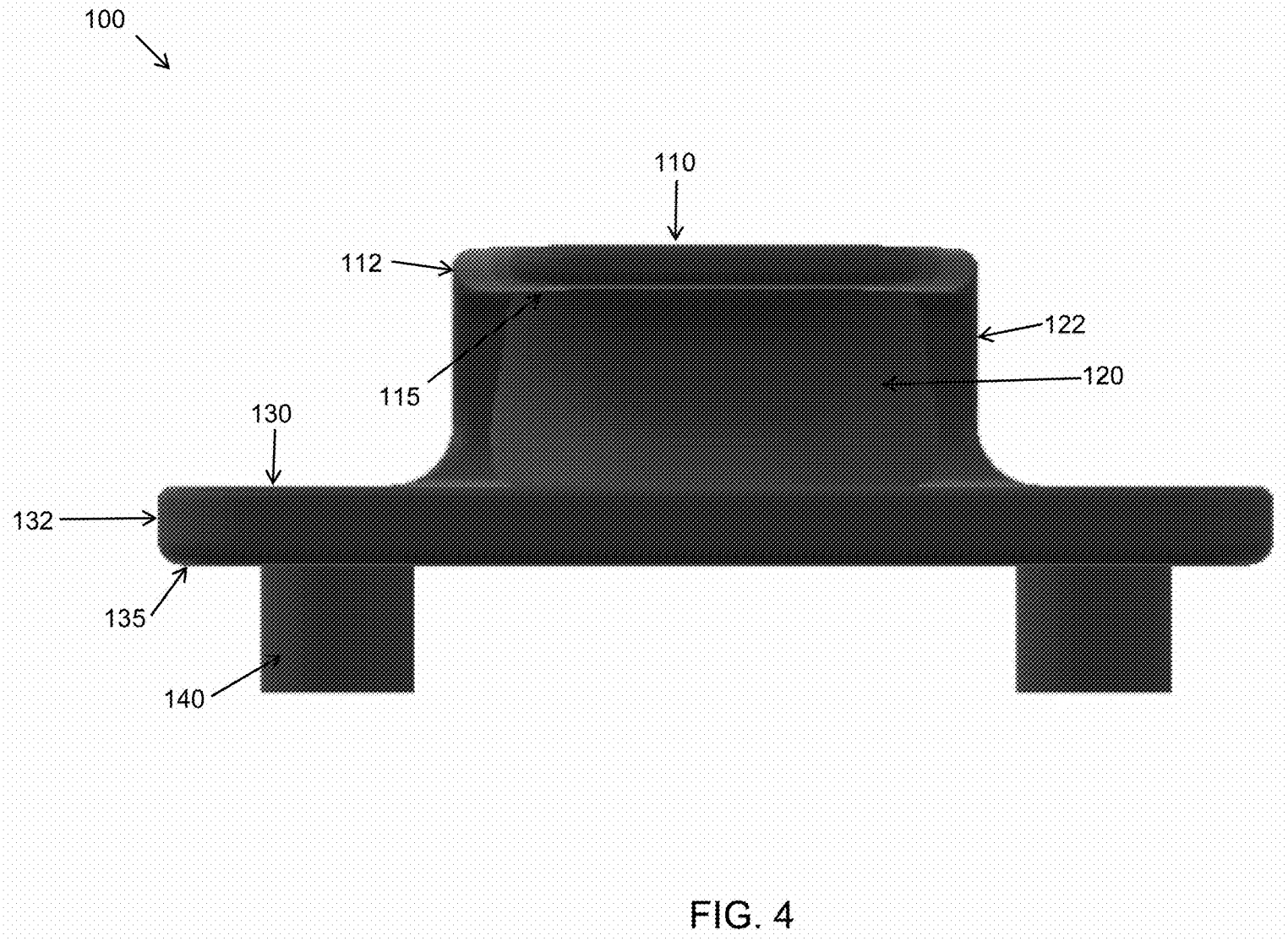
FIG. 4 is a front view of the hook of FIG. 1.

FIG. 4 is a front view of the hook 100 of FIG. 1.

Figure 5:
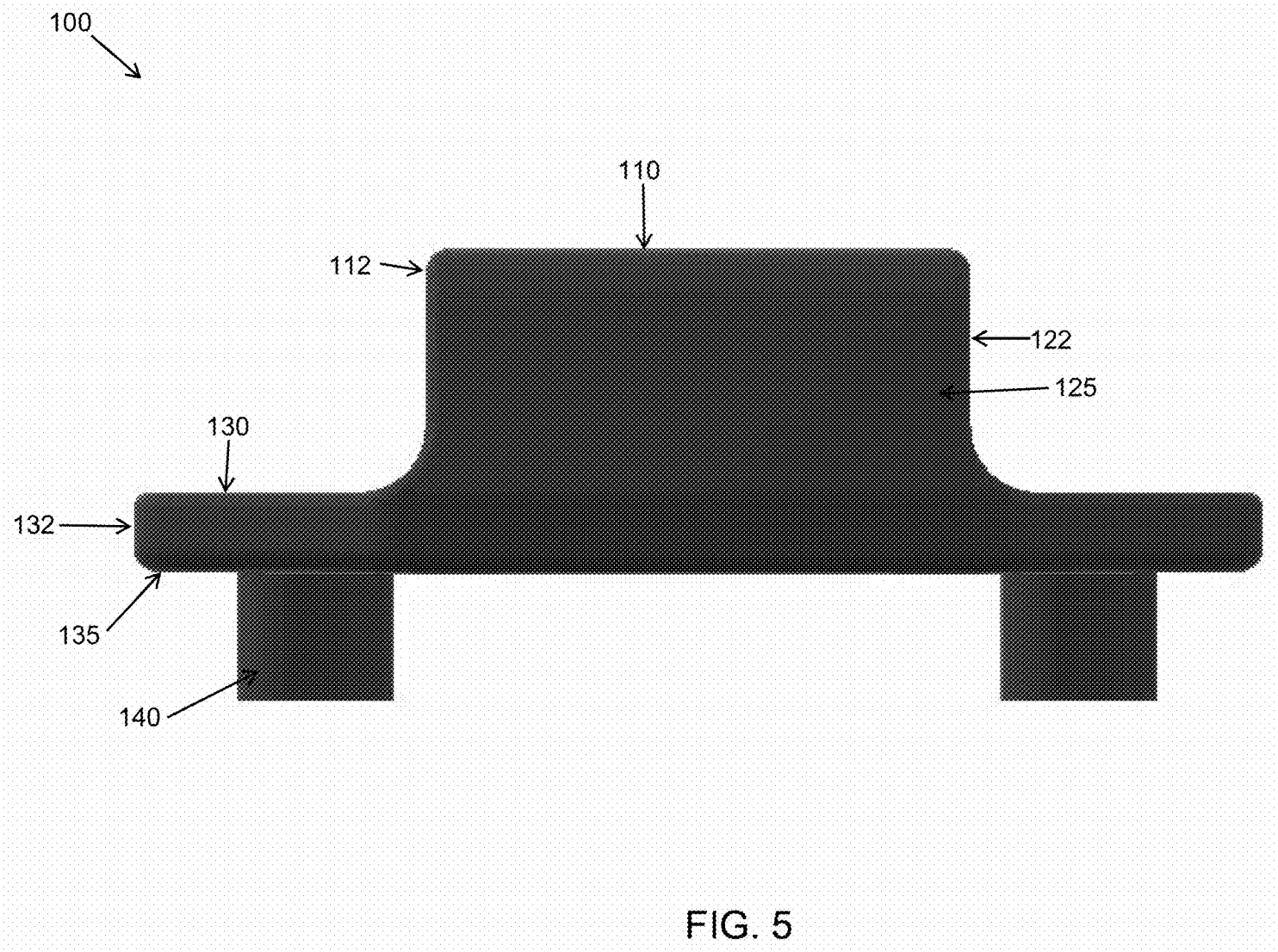
FIG. 5 is a back view of the hook of FIG. 1.

FIG. 5 is a back view of the hook 100 of FIG. 1.

Figure 6:
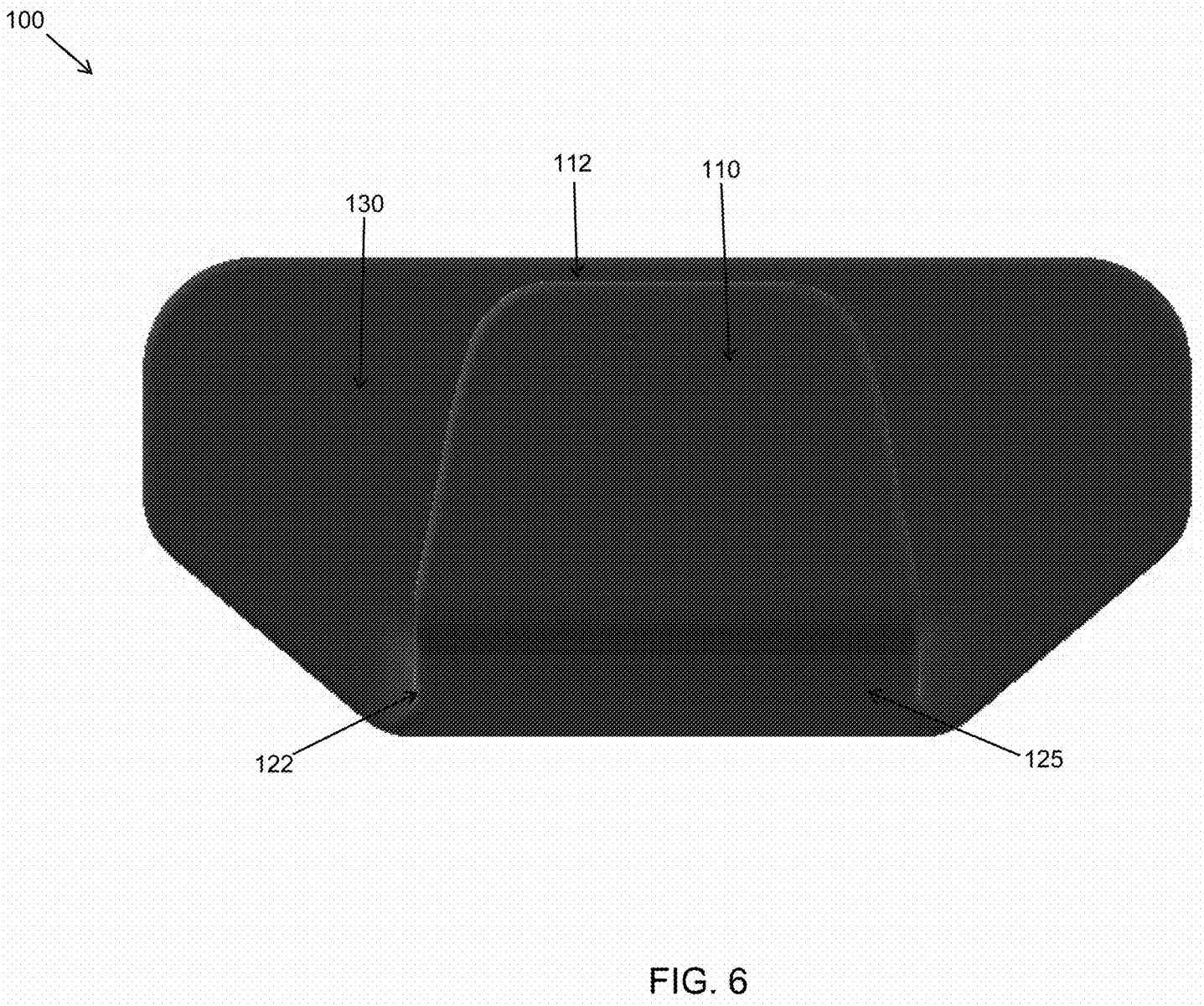
FIG. 6 is a top view of the hook of FIG. 1.

FIG. 6 is a top view of the hook 100 of FIG. 1.

Figure 7:
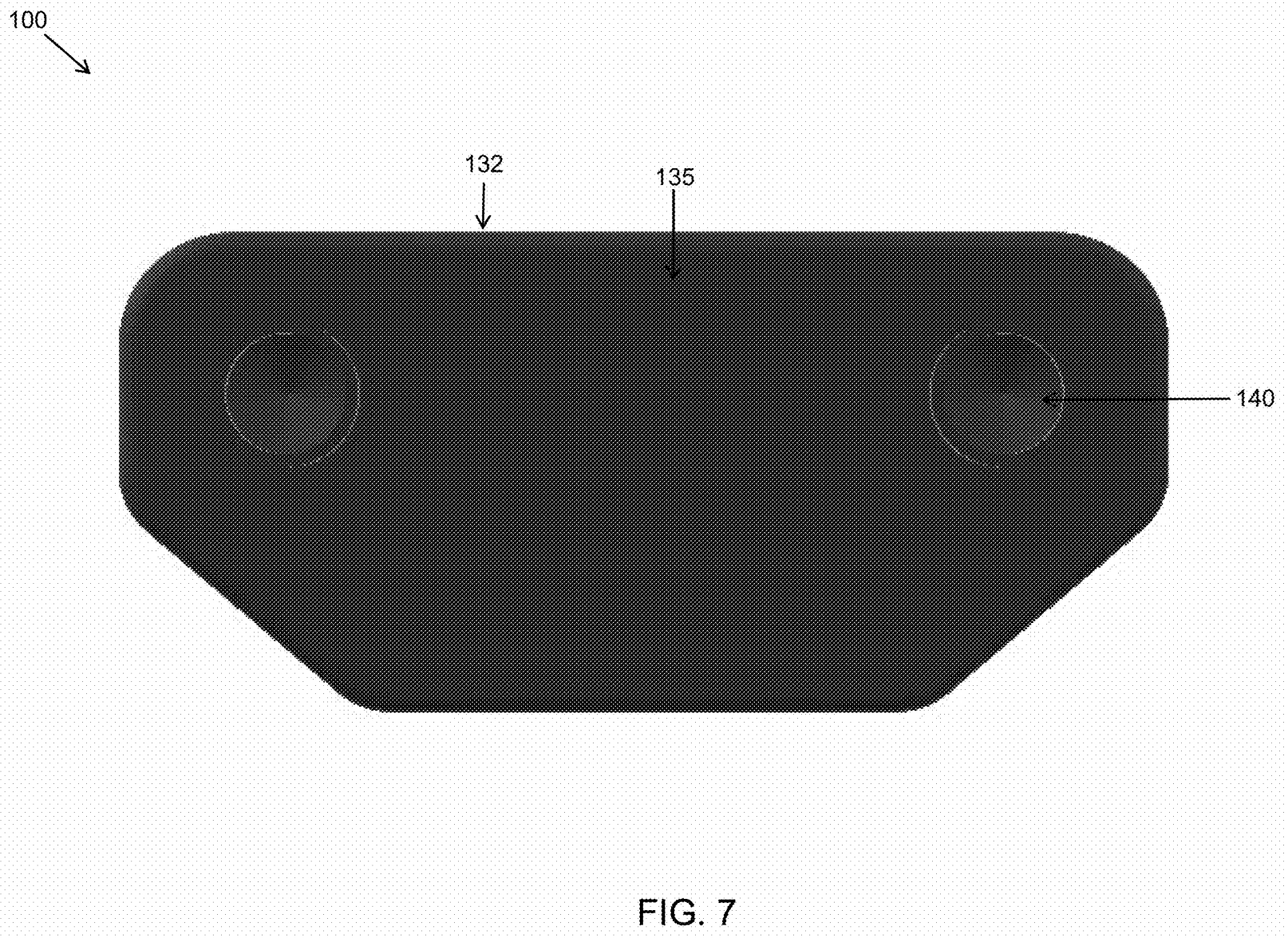
FIG. 7 is a bottom view of the hook of FIG. 1.

FIG. 7 is a bottom view of the hook 100 of FIG. 1.

Figure 8A:
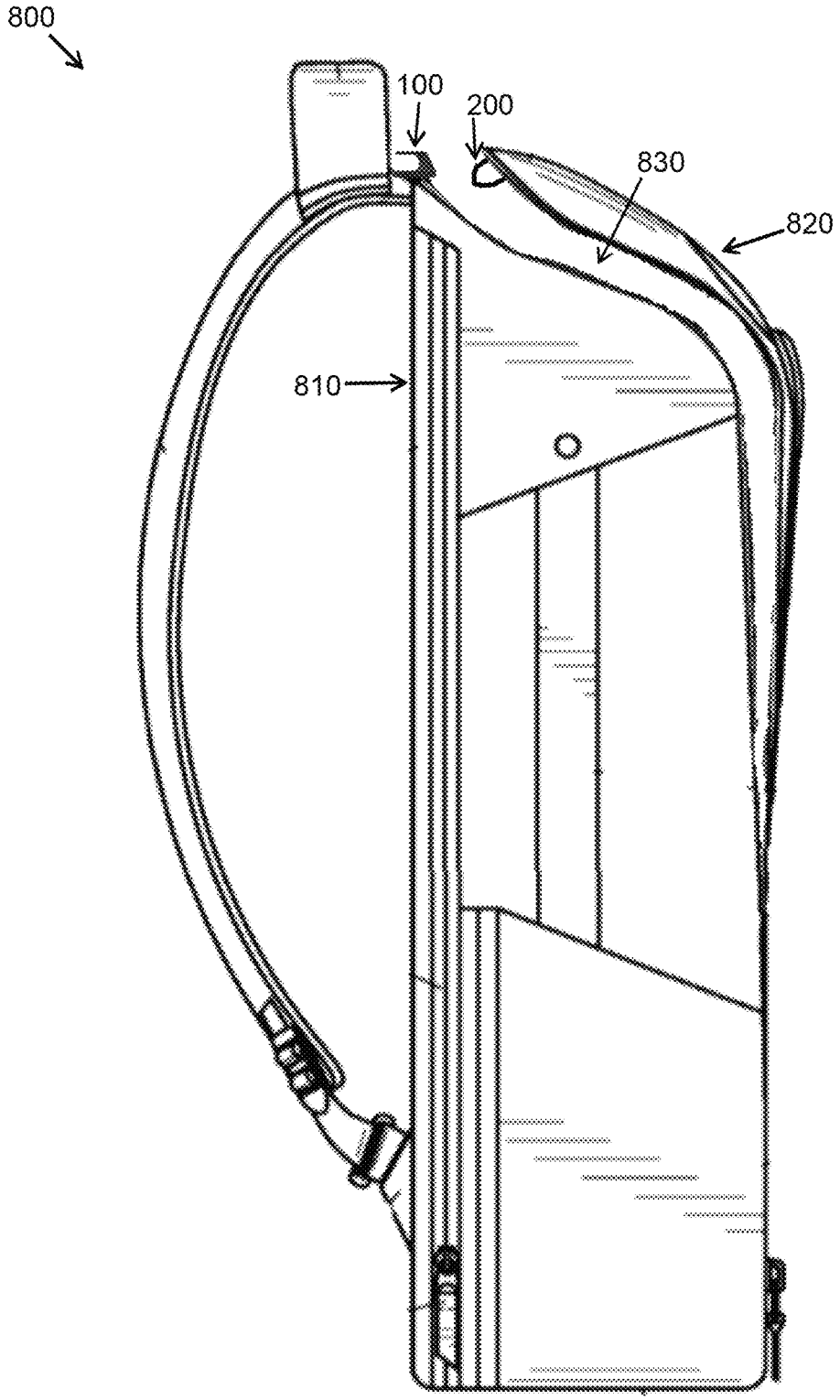
FIG. 8A is an example bag with an open flap according to one or more embodiments.

FIG. 8A is an example bag 800 with an open flap according to one or more embodiments. The bag 800 may include a body 810 and a flap 820. The body may form a cavity 830. The body 810 may include a hook 100. The flap 820 may include a cord 200. The flap 820 may be attached to the body 810. The flap 820 may be attached to the body 810 at a first end of the flap while a second end of the flap may not be attached to the body 810. The cord 200 may be attached to the flap 820 at the second end of the flap 820 which is not attached to the body 810. The flap 820 may be sized to cover the cavity 830 formed by the body 810. A first end of the cord 200 and a second end of the cord 200 may be attached to the flap 820. A middle portion of the cord 200 may extend between the first end and the second end of the cord 200. In some embodiments, the cord 200 may lie flat against the flap 820 when it is not engaged with the hook 100.

The hook 100 may be the hook of FIGS. 1-7. The hook 100 may be attached to the body 810. In some embodiments, the hook 100 may be attached to the body 810 using the one or more rivets 140 of the hook 100. The hook 100 may be attached to a top of the body 810. The hook 100 may be attached to the bag 810 at a location where the flap 820 is not attached to the body 810. The hook 100 may be metal, wood, plastic, or another rigid material. The hook 100 may be configured to receive the cord 200. In some embodiments, the cord may be an elastic cord. The cord 200 may bias the panel 820 towards the body 810. The cord 200 may be elastic enough to stretch over the hook 100. The cord 200 may be tight enough to hold the flap 820 firmly against the body 810.

In some embodiments, the hook 100 may be another element configured to receive the cord 200. The hook 100 may be cylindrical post extending from the body 810 having a flat top with a surface area several times larger than the circular cross-section of the cylindrical post. In some embodiments, the flat top of the cylindrical post may be disc-shaped. In other embodiments, the flat top of the cylindrical post may be square, rectangular, or another shape. In yet other embodiments, the post may be square, rectangular, or another shape.

In some embodiments, the flap 820 is a rigid panel. The flap 820 may form a flap cavity within the rigid panel of the flap 820. The flap 820 may be hingeably attached to the body 810. The bag 800 may include a hinge portion connecting the body 810 and the flap 820. The flap cavity may combine with the cavity 830 formed by the body 810 when the flap 820 covers the cavity. The flap cavity may combine with the cavity 830 to form a combined cavity larger than the flap cavity or the cavity 830. The flap cavity may be smaller, the same size, or larger than the cavity 830 formed by the body 810. In some embodiments, the flap 820 and the body 810 are equal in size. The flap 820 and the body 810 may be identical or mirror images of each other. The flap 820 and the body 810 may be interchangeable except that the hook 100 is attached to the body 810 and the cord 200 is attached to the flap 820. In other embodiments, the hook 100 may be attached to the panel 820 and the cord 200 may be attached to the body 810.

Figure 8B:
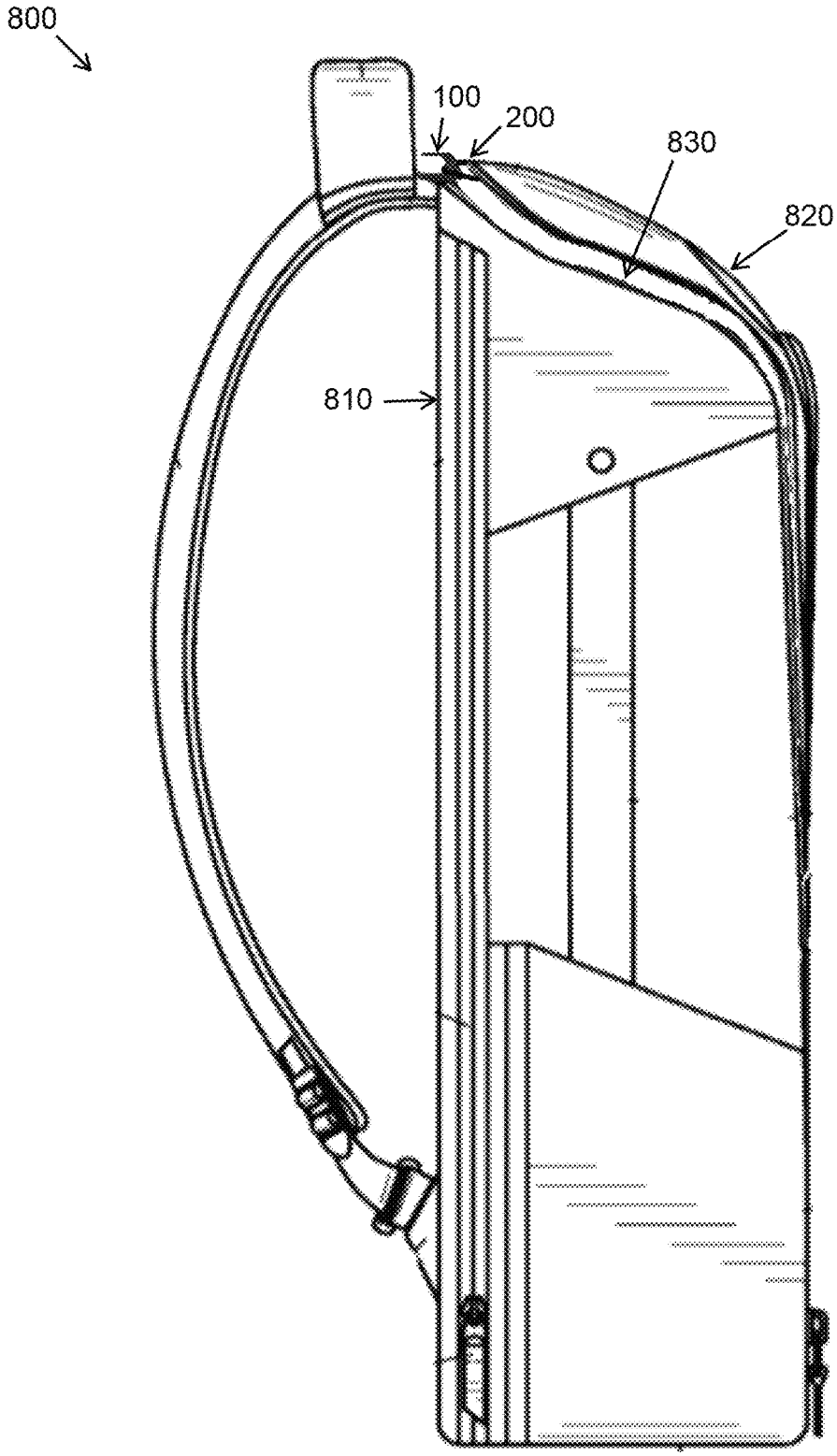
FIG. 8B is an example bag with a closed flap according to one or more embodiments.

FIG. 8B is an example bag 800 with a closed flap according to one or more embodiments. The bag 800 may be the bag 800 of FIG. 8A, except that the cord 200 is engaged with the hook 100 such that the panel 820 is held to the body 810. The panel 820 may be held to the body such that the panel 820 covers the cavity 830. The panel 820 may cover the cavity 830 without being flush against the body 810. In some embodiments, the panel 820 may be held against the body 810 by the hook 100 and cord 200 such that a gap remains between the panel 820 and the body 810. In other embodiments, the panel 820 may be held against the body 810 such that a portion of the cavity 830 is covered by the panel. In yet other embodiments, the panel 820 may be held against the body 810 such that a panel cavity formed by the panel 820 combines with the cavity 830 formed by the body 810 to form a combined cavity. In additional embodiments, the panel 820 may extend into the body 810 to reduce the volume of the cavity 830.

Figure 9A:
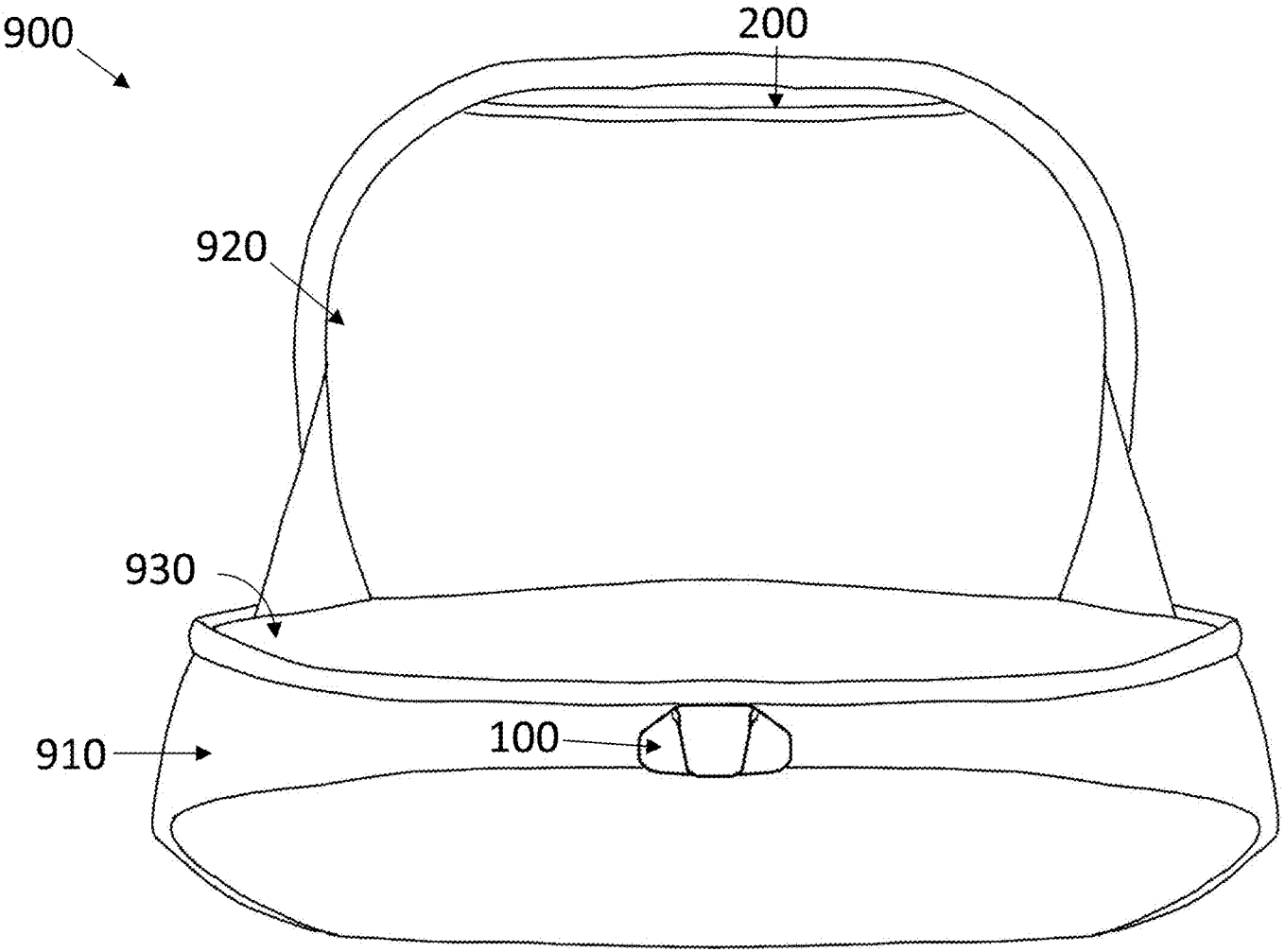
FIG. 9A is an example bag with an open flap according to one or more embodiments.

FIG. 9A is an example bag 900 with an open flap according to one or more embodiments. The bag 900 may include a body 910, a flap, 200, and a cavity 930 formed by the body 910. The bag 900 may be similar to the bag 800 of FIGS. 8A and 8B. The body 910 may include a hook 100. The flap 920 may include a cord 200. The hook 100 may be configured to receive the cord 200. The flap 920 may be attached to the body 910. The flap 920 may be attached to the body 910 at a first end of the flap while a second end of the flap may not be attached to the body 910. The cord 200 may be attached to the flap 920 at the second end of the flap 920 that is not attached to the body 910. The flap 920 may be sized to cover the cavity 930 formed by the body 910. A first end of the cord 200 and a second end of the cord 200 may be attached to the flap 920. A middle portion of the cord 200 may extend between the first end and the second end of the cord 200. In some embodiments, the cord 200 may lie flat against the flap 920 when it is not engaged with the hook 100.

The hook 100 may be the hook of FIGS. 1-7. The hook 100 may be attached to the body 910 using the one or more rivets 140 of the hook 100. The hook 100 may be attached to a top of the body 910. The hook 100 may be attached to the bag 910 at a location where the flap 920 is not attached to the body 910. The hook 100 may be metal, wood, plastic, or another rigid material. The hook 100 may be configured to receive the cord 200. In some embodiments, the cord may be an elastic cord. The cord 200 may bias the panel 920 towards the body 910. The cord 200 may be elastic enough to stretch over the hook 100. The cord 200 may be tight enough to hold the flap 920 firmly against the body 910.

In some embodiments, the hook 100 may be another element configured to receive the cord 200. The hook 100 may be cylindrical post extending from the body 810 having a flat top with a surface area several times larger than the circular cross-section of the cylindrical post. In some embodiments, the flat top of the cylindrical post may be disc-shaped. In other embodiments, the flat top of the cylindrical post may be square, rectangular, or another shape.

In some embodiments, the flap 920 is a rigid panel. The flap 920 may be hingeably attached to the body 910. The bag 900 may include a hinge portion connecting the body 910 and the flap 920. The flap 920 may be configured to cover the cavity 930 and add to the volume of the cavity 930 by forming a flap cavity within the rigid panel of the flap 920. The flap cavity may be smaller, the same size, or larger than the cavity 930 formed by the body 910. In some embodiments, the flap 920 and the body 910 are equal in size. The flap 920 and the body 910 may be mirror images of each other. The flap 920 and the body 910 may be interchangeable except that the hook 100 is attached to the body 910 and the cord 200 is attached to the flap 920. In other embodiments, the hook 100 may be attached to the panel 920 and the cord 200 may be attached to the body 910.

Figure 9B:
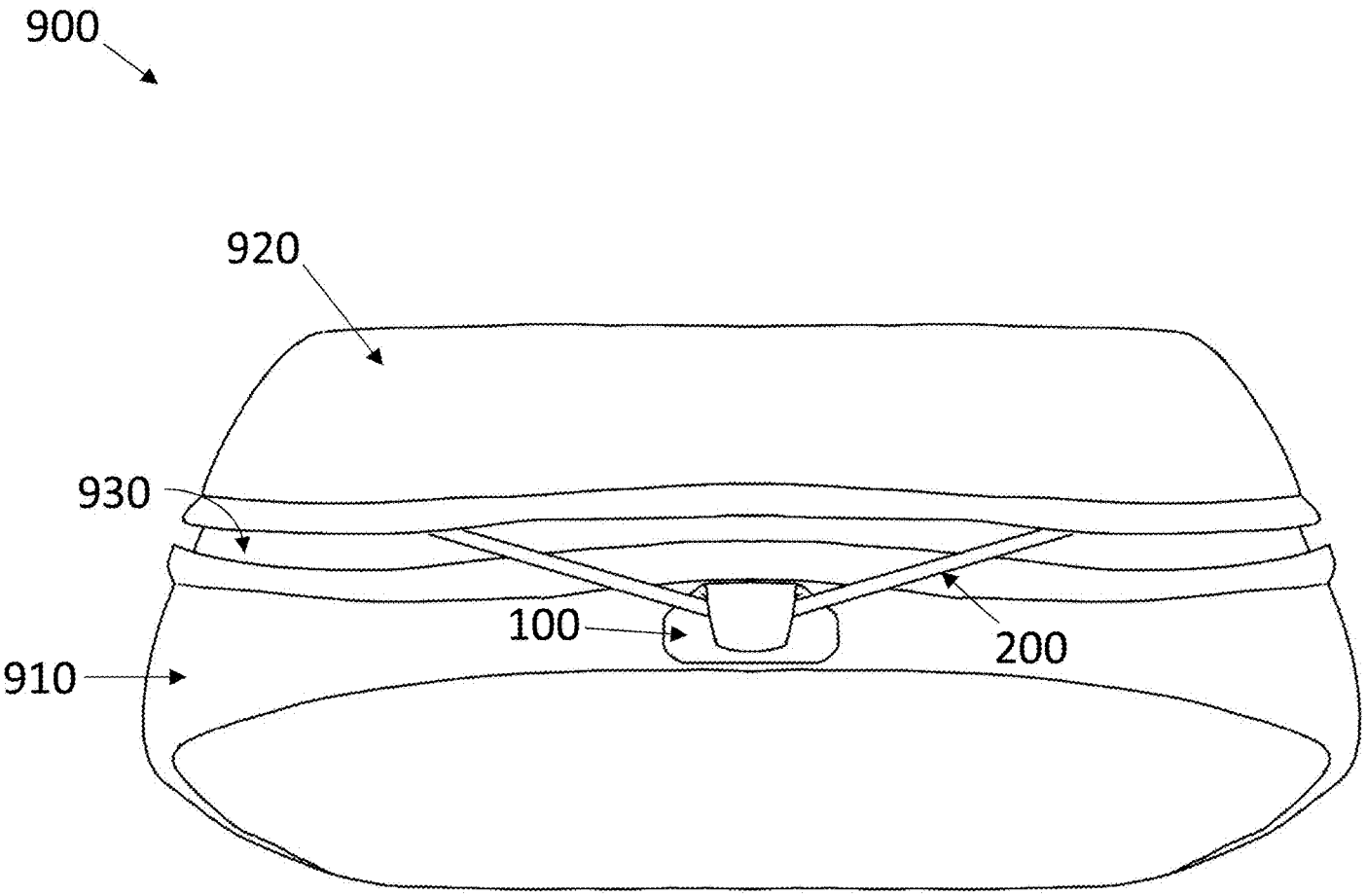
FIG. 9B is an example bag with a closed flap according to one or more embodiments.

FIG. 9B is an example bag 900 with a closed flap according to one or more embodiments. The bag 900 may be the bag 900 of FIG. 9A, except that the cord 200 is engaged with the hook 100 such that the panel 920 is held to the body 910. The panel 920 may be held to the body such that the panel 920 covers the cavity 930. The panel 920 may cover the cavity 930 without being flush against the body 910. In some embodiments, the panel 920 may be held against the body 910 by the hook 100 and cord 200 such that a gap remains between the panel 920 and the body 910. In other embodiments, the panel 920 may be held against the body 910 such that a portion of the cavity 930 is covered by the panel. In yet other embodiments, the panel 920 may be held against the body 910 such that a panel cavity formed by the panel 920 combines with the cavity 930 formed by the body 910 to form a combined cavity. In additional embodiments, the panel 920 may extend into the body 910 to reduce the volume of the cavity 930.

Figure 10:
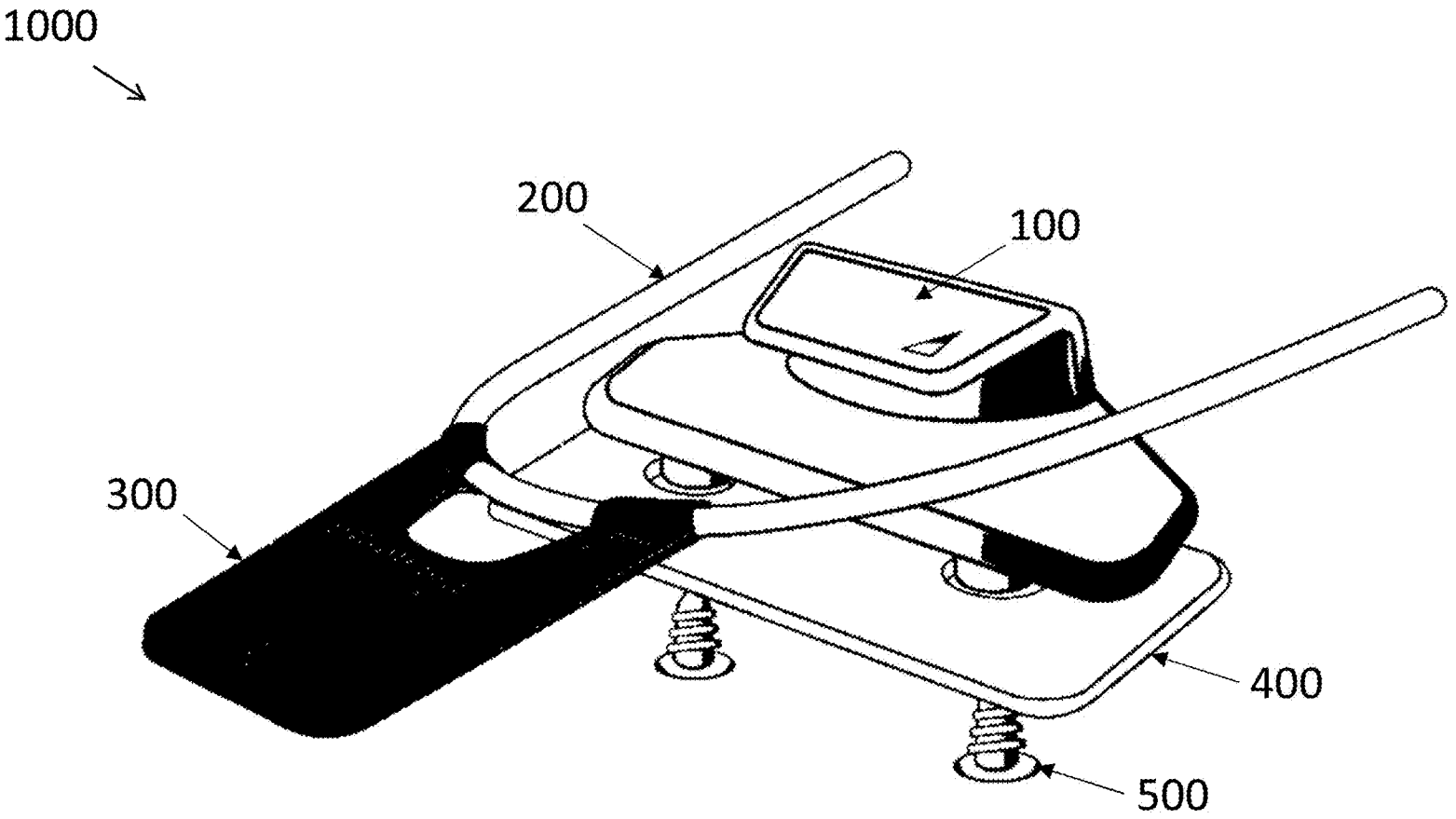
FIG. 10 is an example hook and cord of a fastening mechanism according to one or more embodiments.

FIG. 10 is an example hook 100 and example cord 200 of an example fastening mechanism 1000 according to one or more embodiments. The hook 100 may be the hook 100 of FIGS. 1-7. The hook 100 may be the hook 100 of FIGS. 8A-9B. The cord 200 may be the cord 200 of FIGS. 8A-9B. The fastening mechanism 1000 may include a tab 300 attached to the cord 200. The tab 300 may be configured to facilitate movement of the cord 200. For example, the tab 300 may be grasped by a user to pull the cord 200 over the hook 100 so that the hook 100 receives the cord 200. In another example, the tab 300 may be grasped by a user to pull the cord 200 out of the hook 100 so that the hook 100 no longer receives the cord 200. These examples illustrate how the tab 300 may facilitate movement of the cord 200 and the fastening and unfastening of a bag having the fastening mechanism 1000. The tab 300 may include a gap such that a first portion of the tab 300 is attached to the cord and a second portion of the tab 300 is attached to the cord and a section of the cord 200 between the first portion and second portion of the tab 300 is not attached to the tab 300. The section of the cord 200 between the first portion and second portion of the tab 300 that is not attached to the tab 300 may engage with the back portion interior surface 120 of the hook 100 when the cord 200 is biased towards the back portion 120 of the hook 100. The gap in the tab 300 may allow the section of the cord 200 between the first portion and second portion of the tab 300 that is not attached to the tab 300 to conform to the back portion interior surface 120. Allowing the cord 200 to conform to the back portion interior surface 120 has the advantage of reducing strain on the cord 200.

The fastening mechanism 1000 may include a support 400. The support 400 may be rigid. The support 400 may serve to stabilize the hook 100 on a surface to which the hook 100 is attached. For example, the support 400 may be located on an interior surface of a bag opposite the hook 100 which is located on an exterior surface of the bag. In another example, the support 400 may be located in the cavity 830 of the body 810 of the bag 800 of FIGS. 8A and 8B, opposite the hook 100. The support 400 may stabilize the hook 100, facilitating easy attachment of the cord 200 to the hook 100.

The fastening mechanism 1000 may include one or more screws 500. The one or more screws 500 may be screws, bolts, plugs, or another fastener. The one or more screws 500 may be configured to attached to the one or more rivets 140 of the hook 100. The one or more screws 500 may pass through the support 400 to attach to the hook 100, securing the support 400 to the hook 100. The one or more screws 500 may pass through the support 400 and a surface to which the hook 100 is attached to secure the support 400 and the hook 100 to the surface. The one or more screws 500 may secure the support 400 and the hook 100 to opposite sides of the surface. For example, the one or more screws 500 may secure the support 400 inside the cavity 830 of the bag 800 to an interior surface of the body 810 and the hook 100 to an exterior surface of the body 810.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "similar," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A bag comprising:

a body forming a cavity;

a flap comprising a first flap end and a second flap end, wherein the first flap end is attached to the body;

a cord having a first end, a second end, and a middle portion, wherein the first end is attached to an interior of the second flap end, the second end is attached to the interior of the second flap end, and the middle portion extends between the first end and the second end; and a hook attached to the body at an attachment location on an external surface of the bag, wherein the hook is configured to receive the middle portion of the cord such that the cord extends from the interior of the second flap end to the hook, the flap is secured to the body at the attachment location, and the flap covers the cavity.

2. The bag of claim 1, wherein the flap comprises a rigid panel.

3. The bag of claim 2, wherein the flap forms a flap cavity that combines with the cavity formed by the body when the flap is secured to the body.

4. The bag of claim 1, wherein the cord is an elastic cord.

5. The bag of claim 1, further comprising a hinge portion hingeably connecting the first flap end to the body.

6. The bag of claim 1, wherein the hook is attached to the body using rivets.

7. The bag of claim 1, wherein the hook includes an upper portion, a lower portion, and a back portion connecting the upper portion and the lower portion.

8. The bag of claim 7, wherein the upper portion is flat, the lower portion is flat, and the back portion has an exterior flat surface and an interior curved surface.

9. The bag of claim 8, wherein the interior curved surface is convex along a first axis and concave along a second axis orthogonal to the first axis.

10. The bag of claim 9, wherein the interior curved surface is configured to reduce strain on the cord.

11. The bag of claim 1, wherein an open portion of the hook faces in a direction towards a side of the bag including shoulder straps.

* * * * *